US011705042B1

(12) United States Patent
Park et al.

(10) Patent No.: US 11,705,042 B1
(45) Date of Patent: Jul. 18, 2023

(54) DISPLAY APPARATUS

(71) Applicant: LG Display Co., Ltd., Seoul (KR)

(72) Inventors: SeRyong Park, Paju-si (KR); MinSik Son, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 18/051,027

(22) Filed: Oct. 31, 2022

(30) Foreign Application Priority Data

Dec. 23, 2021 (KR) ..... 10-2021-0186125

(51) Int. Cl.
*G09G 3/20* (2006.01)

(52) U.S. Cl.
CPC ..... *G09G 3/20* (2013.01); *G09G 3/2096* (2013.01); *G09G 2300/0828* (2013.01); *G09G 2300/0842* (2013.01); *G09G 2310/0275* (2013.01); *G09G 2310/0291* (2013.01); *G09G 2310/08* (2013.01)

(58) Field of Classification Search
CPC ..... G09G 3/20; G09G 2300/0828; G09G 2300/0842; G09G 2310/0291; G09G 2310/0275; G09G 2310/08
See application file for complete search history.

(56) References Cited

U.S. PATENT DOCUMENTS 11,151,919 B2 10/2021 Yoon et al.
2023/0018128 A1* 1/2023 Byeon ..... G09G 3/2092

FOREIGN PATENT DOCUMENTS

KR 2019-0095640 A 8/2019

* cited by examiner

*Primary Examiner* — Gerald Johnson
(74) *Attorney, Agent, or Firm* — Polsinelli PC

(57) ABSTRACT

A display apparatus includes a display panel including a gate line and a data line, a controller generating a source output enable signal determining an output timing of a data voltage output to the data line, and a data driver including a signal changer, generating a final source output enable signal by using the source output enable signal, and randomly changing the output timing of the data voltage for each gate line by using the final source output enable signal.

11 Claims, 6 Drawing Sheets

DISPLAY APPARATUS

CROSS-REFERENCE TO RELATED APPLICATION

This application claims the priority of the Korean Patent Application No. 10-2021-0186125 filed on Dec. 23, 2021, which is hereby incorporated by reference in its entirety.

BACKGROUND

Field of the Disclosure

The present disclosure relates to a display apparatus.

Description of the Background

Recently, display apparatuses to which spread spectrum clock generation (SSCG) is applied have been proposed.

In display apparatuses to which SSCG is applied, an electromagnetic interference (EMI) reduction effect may be realized based on dispersion of periodicity of digital data and a spreading effect of an analog output.

However, as display apparatuses having a high resolution increase, a transfer speed of digital data is increasing, and due to this, there is a limitation in a level of applicable SSCG.

Particularly, in display apparatuses to which SSCG is applied, because a constant timing at which data voltages are output to horizontal lines are fixed, an EMI reduction effect is decreasing.

SUMMARY

Accordingly, the present disclosure is directed to providing a display apparatus that substantially obviates one or more problems due to limitations and disadvantages described above.

More specifically, the present disclosure is directed to providing a display apparatus which may randomly change an output timing of a data voltage for each gate line.

Additional advantages and features of the disclosure will be set forth in part in the description which follows and in part will become apparent to those having ordinary skill in the art upon examination of the following or may be learned from practice of the disclosure. Other advantages of the disclosure may be realized and attained by the structure particularly pointed out in the written description and claims hereof as well as the appended drawings.

To achieve these and other advantages and in accordance with the purpose of the disclosure, as embodied and broadly described herein, a display apparatus includes a display panel including a gate line and a data line, a controller generating a source output enable signal determining an output timing of a data voltage output to the data line, and a data driver including a signal changer, generating a final source output enable signal by using the source output enable signal, and randomly changing the output timing of the data voltage for each gate line by using the final source output enable signal.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate aspects of the disclosure and together with the description serve to explain the principle of the disclosure.

In the drawings.

DETAILED DESCRIPTION

Figure 1:
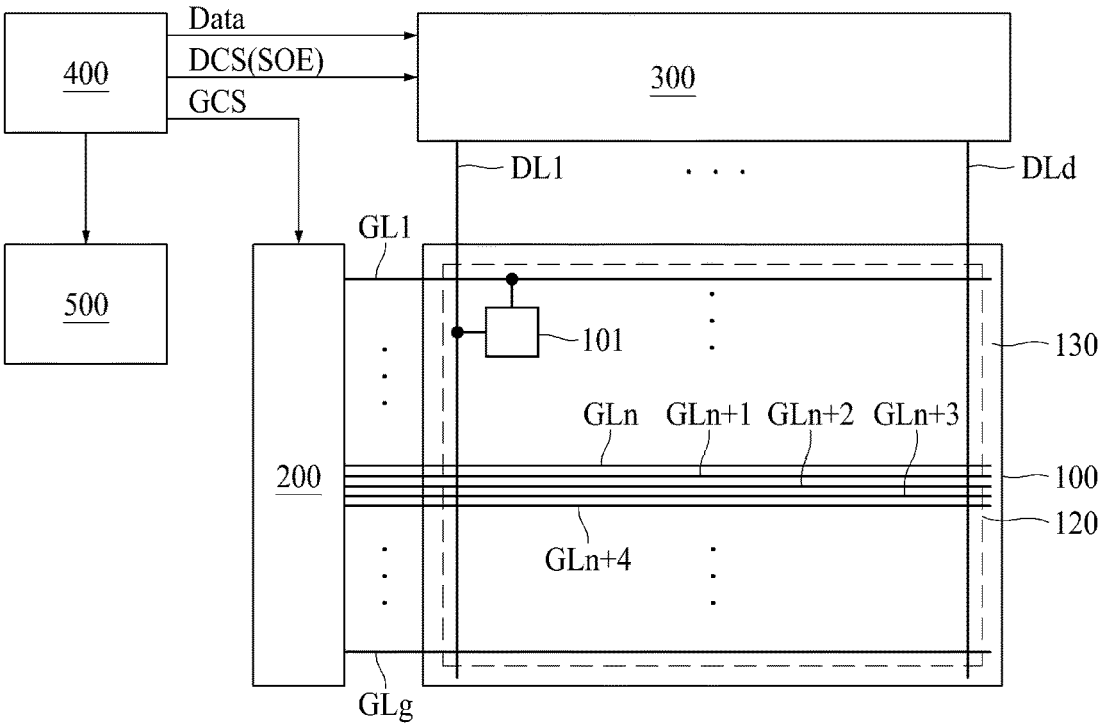
FIG. 1 is an exemplary diagram illustrating a configuration of a display apparatus according to the present disclosure.

Reference will now be made in detail to the exemplary aspects of the present disclosure, examples of which are illustrated in the accompanying drawings. Wherever possible, the same reference numbers will be used throughout the drawings to refer to the same or like parts.

Advantages and features of the present disclosure, and implementation methods thereof will be clarified through following aspects described with reference to the accompanying drawings. The present disclosure may, however, be embodied in different forms and should not be construed as limited to the aspects set forth herein. Rather, these aspects are provided so that this disclosure will be thorough and complete, and will fully convey the scope of the present disclosure to those skilled in the art. Further, the present disclosure is only defined by scopes of claims.

A shape, a size, a ratio, an angle, and a number disclosed in the drawings for describing aspects of the present disclosure are merely an example, and thus, the present disclosure is not limited to the illustrated details. Like reference numerals refer to like elements throughout. In the following description, when the detailed description of the relevant known function or configuration is determined to unnecessarily obscure the important point of the present disclosure, the detailed description will be omitted. When "comprise," "have," and "include" described in the present specification are used, another part may be added unless "only" is used. The terms of a singular form may include plural forms unless referred to the contrary.

In construing an element, the element is construed as including an error or tolerance range although there is no explicit description of such an error or tolerance range.

In describing a position relationship, for example, when a position relation between two parts is described as, for example, "on," "over," "under," and "next," one or more other parts may be disposed between the two parts unless a more limiting term, such as "just" or "direct(ly)" is used.

In describing a time relationship, for example, when the temporal order is described as, for example, "after," "subsequent," "next," and "before," a case that is not continuous may be included unless a more limiting term, such as "just," "immediate(ly)," or "direct(ly)" is used.

It will be understood that, although the terms "first," "second," etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

In describing elements of the present disclosure, the terms "first," "second," "A," "B," "(a)," "(b)," etc. may be used. These terms are intended to identify the corresponding elements from the other elements, and basis, order, or number of the corresponding elements should not be limited by these terms. The expression that an element is "connected," "coupled," or "adhered" to another element or layer the element or layer can not only be directly connected or adhered to another element or layer, but also be indirectly connected or adhered to another element or layer with one or more intervening elements or layers "disposed," or "interposed" between the elements or layers, unless otherwise specified.

The term "at least one" should be understood as including any and all combinations of one or more of the associated listed items. For example, the meaning of "at least one of a first item, a second item, and a third item" denotes the combination of all items proposed from two or more of the first item, the second item, and the third item as well as the first item, the second item, or the third item.

Features of various aspects of the present disclosure may be partially or overall coupled to or combined with each other, and may be variously inter-operated with each other and driven technically as those skilled in the art can sufficiently understand. The aspects of the present disclosure may be carried out independently from each other, or may be carried out together in co-dependent relationship.

Hereinafter, aspects of the present disclosure will be described in detail with reference to the accompanying drawings.

Figure 2:
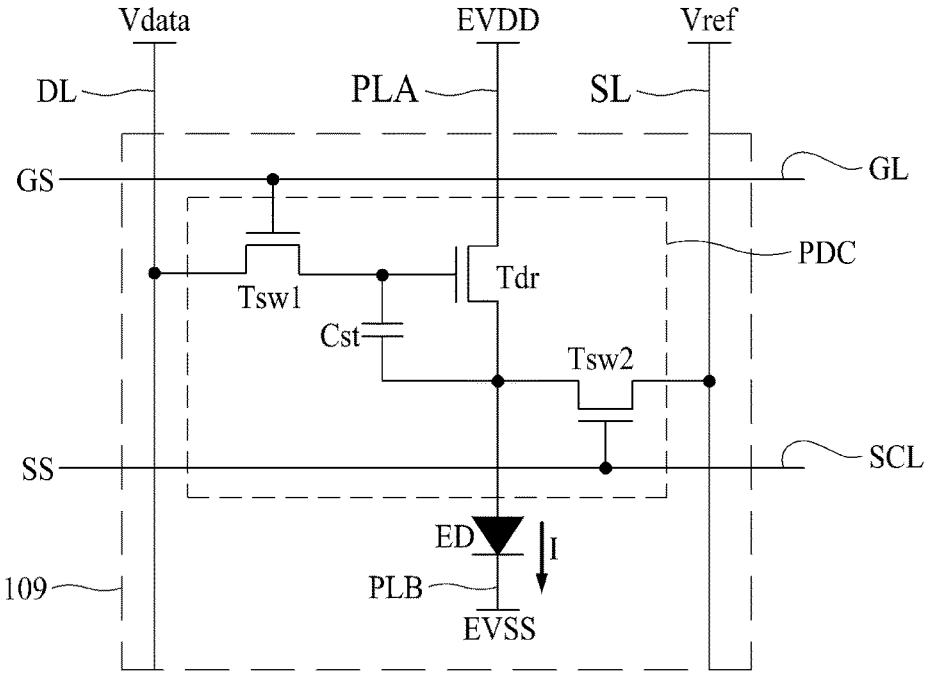
FIG. 2 is an exemplary diagram illustrating a structure of a pixel applied to a display apparatus according to the present disclosure.
Figure 3:
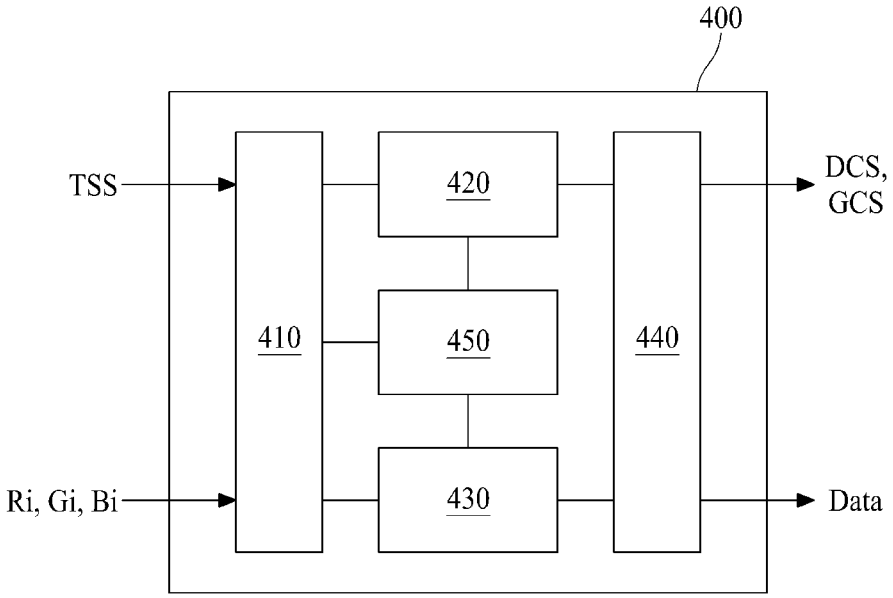
FIG. 3 is an exemplary diagram illustrating a configuration of a controller applied to a display apparatus according to the present disclosure.
Figure 4:
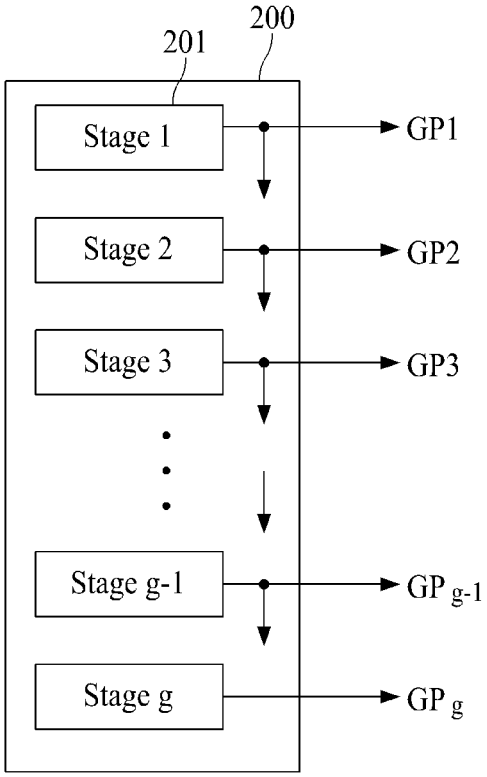
FIG. 4 is an exemplary diagram illustrating a configuration of a gate driver applied to a display apparatus according to the present disclosure.

FIG. 1 is an exemplary diagram illustrating a configuration of a display apparatus according to the present disclosure, FIG. 2 is an exemplary diagram illustrating a structure of a pixel applied to the display apparatus according to the present disclosure, FIG. 3 is an exemplary diagram illustrating a configuration of a controller applied to the display apparatus according to the present disclosure, and FIG. 4 is an exemplary diagram illustrating a configuration of a gate driver applied to the display apparatus according to the present disclosure.

The display apparatus according to the present disclosure may configure various electronic devices. The electronic devices may include, for example, smartphones, tablet personal computers (PCs), televisions (TVs), and monitors.

The display apparatus according to the present disclosure, as illustrated in FIG. 1, may include a display panel 100 which includes a display area 120 displaying an image and a non-display area 130 provided outside the display area 120, a gate driver 200 which supplies a gate signal to a plurality of gate lines GL1 to GLg provided in the display area 120 of the display panel 100, a data driver 300 which supplies data voltages to a plurality of data lines DL1 to DLd provided in the display panel 100, a controller 400 which controls driving of the gate driver 200 and the data driver 300, and a power supply 500 which supplies power to the controller, the gate driver, the data driver, and the display panel.

First, the display panel 100 may include the display area 120 and the non-display area 130. The gate lines GL1 to GLg, the data lines DL1 to DLd, and the pixels 110 may be provided in the display area 120. Accordingly, the display area 120 may display an image. Here, g and d may each be a natural number. The non-display area 130 may surround an outer portion of the display area 120.

The pixel 110 included in the display panel 100, as illustrated in FIG. 2, may include an emission area which includes a pixel driving circuit PDC, including a switching transistor Tsw1, a storage capacitor Cst, a driving transistor Tdr, and a sensing transistor Tsw2, and a light emitting device ED.

A first terminal of the driving transistor Tdr may be connected to a high voltage supply line PLA through which a high voltage EVDD is supplied, and a second terminal of the driving transistor Tdr may be connected to the light emitting device ED.

A first terminal of the switching transistor Tsw1 may be connected to a data line DL, a second terminal of the switching transistor Tsw1 may be connected to a gate of the driving transistor Tdr, and a gate of the switching transistor Tsw1 may be connected to a gate line GL.

A data voltage Vdata may be supplied to the data line DL, and a gate signal GS may be supplied to the gate line GL.

The sensing transistor Tsw2 may be provided for measuring a threshold voltage or mobility of the driving transistor. A first terminal of the sensing transistor Tsw2 may be connected to a second terminal of the driving transistor Tdr and the light emitting device ED, a second terminal of the sensing transistor Tsw2 may be connected to a sensing line SL through which a reference voltage Vref is supplied, and a gate of the sensing transistor Tsw2 may be connected to a sensing control line through which a sensing control signal is supplied.

The sensing line SL may be connected to the data driver 300 and may also be connected to the power supply 500 through the data driver 300. That is, the reference voltage Vref supplied from the power supply 500 may be supplied to the pixels through the sensing line SL, and sensing signals transferred from the pixels may be processed by the data driver 300.

A structure of the pixel 110 applied to the present disclosure is not limited to a structure illustrated in FIG. 2. Accordingly, a structure of the pixel 110 may be changed to various shapes.

Moreover, the present disclosure may be applied to a liquid crystal display (LCD) apparatus including a liquid crystal display panel as well as a light emitting display apparatus including a light emitting device illustrated in FIG. 2. That is, the present disclosure may be applied to various kinds of display apparatuses which are being currently used. Hereinafter, however, for convenience of description, a light emitting display apparatus will be described as an example of the present disclosure.

The controller 400 may realign input video data transferred from an external system by using a timing synchronization signal transferred from the external system and may generate data control signals DCS which are to be supplied to the data driver 300 and gate control signals GCS which are to be supplied to the gate driver 200.

To this end, as illustrated in FIG. 3, the controller 400 may include a data aligner 430 which realigns input video data to generate image data Data and supplies the image data Data to the data driver 300, a control signal generator 420 which generates the gate control signal GCS and the data control signal DCS by using the timing synchronization signal, an input unit 410 which receives the timing synchronization signal and the input video data transferred from the external system and respectively transfers the timing synchronization signal and the input video data to the data aligner and the control signal generator 420, and an output unit 440 which supplies the data driver 300 with the image data Data generated by the data aligner and the data control signal DCS generated by the control signal generator 420 and supplies the gate driver 200 with the gate control signal GCS generated by the control signal generator 420.

The controller 400 may include a storage unit 450 for storing various information.

The data control signals DCS generated by the control signal generator 420 may include a source output enable signal SOE which controls a timing at which data voltages are output to data lines.

The source output enable signal SOE generated by the control signal generator 420 may be transferred to the data driver 300.

That is, the controller 400 may generate the source output enable signal SOE which determines an output timing of a data voltage Vdata output to the data line DL, and the generated source output enable signal SOE may be transferred to the data driver 300.

The external system may perform a function of driving the controller 400 and an electronic device. For example, when the electronic device is a TV, the external system may receive various sound information, video information, and letter information over a communication network and may transfer the received video information to the controller 400. In this case, the image information may include input video data.

The power supply 500 may generate various powers and may supply the generated powers to the controller 400, the gate driver 200, the data driver 300, and the display panel 100.

The gate driver 200 may be configured as an IC and mounted in the non-display area 130. Also, the gate driver 200 may be directly embedded in the non-display area 130 by using a gate in panel (GIP) type. In a case which uses the GIP type, transistors configuring the gate driver 200 may be provided in the non-display area through the same process as transistors included in each of the pixels 110.

The gate driver 200 may supply gate pulses GP1 to GPg to the gate lines GL1 to GLg.

When a gate pulse generated by the gate driver 200 is supplied to the switching transistor Tsw1 included in the pixel 110, the switching transistor Tsw1 may be turned on. When the switching transistor Tsw1 is turned on, a data voltage supplied through a data line may be supplied to the pixel 110.

When a gate off signal generated by the gate driver 200 is supplied to the switching transistor Tsw1, the switching transistor Tsw1 may be turned off. When the switching transistor Tsw1 is turned off, a data voltage may not be supplied to the pixel 110 any longer.

A gate signal GS supplied to the gate line GL may include the gate pulse GP and the gate off signal.

To this end, as illustrated in FIG. 4, the gate driver 200 may include a plurality of stages 201.

Each of the stages 201 may be connected to at least one gate line GL. Each of the stages 201 may be driven by a start signal transferred from the controller 400, or may be driven by a start signal transferred from a previous stage or a next stage.

Each of the stages 201 may include at least two transistors and may be configured in various forms.

Finally, the data driver 300 may be included in a chip on film (COF) attached on the display panel 100, or may be directly equipped in the display panel 100.

The data driver 300 may supply the data voltages Vdata to the data lines DL1 to DLd.

The data driver 300 may shift a source start pulse transferred from the controller 400 on the basis of a source shift clock to generate a sampling signal. Also, the data driver 300 may latch pieces of image data on the basis of the sampling signal, convert the latched pieces of image data into data voltages, and supply the data lines DL1 to DLd with data voltages corresponding to a gate line on the basis of a final source output enable signal.

Particularly, the data driver 300 may perform a function of randomly changing an output timing of the data voltage Vdata for each gate line by using the source output enable signal SOE transferred from the controller 400.

Hereinafter, a structure and a function of the data driver 300 will be described with reference to FIGS. 1 to 8.

Figure 5:
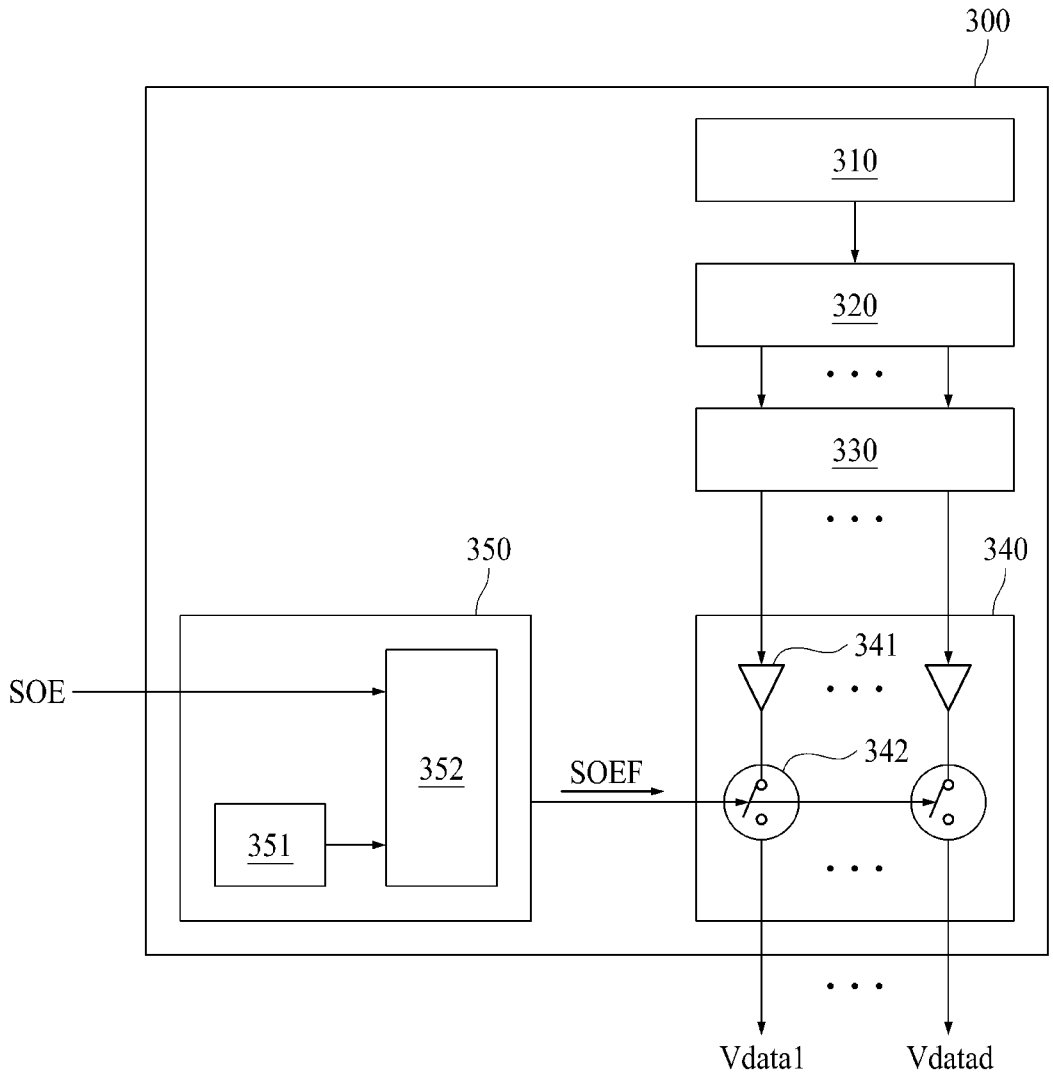
FIG. 5 is an exemplary diagram illustrating a configuration of a data driver applied to a display apparatus according to the present disclosure.

FIG. 5 is an exemplary diagram illustrating a configuration of a data driver applied to the display apparatus according to the present disclosure.

As described above, the data driver 300 may latch pieces of image data transferred from the controller 400 on the basis of the sampling signal, convert the latched pieces of image data into data voltages, and supply the data lines DL1 to DLd with data voltages corresponding to a gate line on the basis of a final source output enable signal.

Particularly, the data driver 300 applied to the present disclosure may perform a function of randomly changing an output timing of the data voltage Vdata for each gate line by using the source output enable signal SOE transferred from the controller 400.

The source output enable signal SOE may have at least four bits. Each of the four bits may have a value of 0 or 1.

That is, the data driver 300 may determine an output timing of each of data voltages on the basis of the source output enable signal SOE consisting of four bits.

However, the data driver 300 may not intactly use the source output enable signal SOE. That is, the data driver 300 may generate a final source output enable signal SOEF by using the source output enable signal SOE and may randomly change an output timing of the data voltage Vdata for each gate line by using the final source output enable signal SOEF.

In this case, the data driver 300 may change at least two of at least four bits to generate the final source output enable signal SOEF and may randomly change an output timing of a data voltage for each gate line by using the final source output enable signal SOEF.

Timings at which the data voltages Vdata are output to the data line DL may vary with respect to falling timings of the gate pulses GP1 to GPg output to the gate lines GL1 to GLg.

To this end, as illustrated in FIG. 5, the data driver 300 may include a shift register 310 which outputs the sampling signal, a latch unit 320 which latches image data Data received from the controller 400, a digital-to-analog converter (DAC) 330 which converts the image data Data, transferred from the latch unit 310, into a data voltage Vdata and outputs the data voltage Vdata, an output buffer 340 which outputs the data voltage, transferred from the DAC 330, to the data line DL on the basis of the final source output enable signal SOEF, and a signal changer which generates the final source output enable signal SOEF by using the source output enable signal SOE and randomly changes an output timing of the data voltage for each gate line by using the final source output enable signal SOEF.

First, the shift register 310 may output the sampling signal by using the data control signals DCS received from the controller 400.

The latch unit 320 may latch pieces of image data Data sequentially received from the controller 400 and may simultaneously output the pieces of image data Data to the DAC 330.

The DAC 330 may simultaneously convert the pieces of image data Data, transferred from the latch unit 320, into data voltages Vdata1 to Vdatad and may output the data voltages Vdata1 to Vdatad.

The output buffer 340 may simultaneously output the data voltages Vdata1 to Vdatad, transferred from the DAC 330, to the data lines DL1 to DLd of the display panel on the basis of the final source output enable signal SOEF transferred from the signal changer 350.

To this end, the output buffer 340 may include a buffer 341 which stores the data voltage Vdata transferred from the DAC 330 and a switch 342 which transfers the data voltage Vdata, stored in the buffer 341, to the data line DL.

That is, the output buffer 340 may include switches 342 and buffers 341 corresponding to the data lines DL1 to DLd.

To provide an additional description, when the switches 342 are turned on based on the final source output enable signal SOEF simultaneously supplied to the switches 342, the data voltages Vdata stored in the buffers 341 may be supplied to the data lines DL1 to DLd through the switches 342.

The data voltages Vdata1 to Vdatad supplied to the data lines DL1 to DLd may be supplied to pixels connected to the gate line GL to which the gate pulse GP is supplied.

Therefore, a timing at which the data voltages Vdata1 to Vdatad are output to the data lines DL1 to DLd may be determined based on the final source output enable signal SOEF.

Finally, the signal changer 350 may generate the final source output enable signal SOEF by using the source output enable signal SOE and may randomly change an output timing of the data voltage Vdata for each gate line by using the final source output enable signal SOEF.

To this end, the signal changer 350 may include a random bit generator 351 which generates at least two random bits and a bit mixer 352 which replaces at least two of at least four bits of the source output enable signal SOE with the at least two random bits to generate the final source output enable signal SOEF.

That is, the source output enable signal SOE which is generated by the controller 400 and is supplied to the data driver 300 may include at least four bits, and the signal changer 350 may change at least two of the at least four bits to generate the final source output enable signal SOEF.

To this end, the random bit generator 351 may generate at least two random bits.

For example, when the final source output enable signal SOEF consists of eight bits and each of the eight bits has a value of 0 or 1, the random bit generator 351 may generate two random bits. Each of the two bits may have a value of 0 or 1

In this case, based on two random bits, the number of cases occurring in the bit mixer 352 may be four. Accordingly, timings at which data voltages are output to the data line DL may be divided into four timings.

For example, when the source output enable signal SOE consisting of eight bits has a value [10111010], two final bits of the eight bits may be changed to one of four values (i.e., [00, 01, 10, 11]) generated by two random bits.

Therefore, the final source output enable signal SOEF finally generated by the bit mixer 352 may be one of values [10111000], [10111001], [10111010], and [10111011].

That is, the signal changer 350 may generate one of four final source output enable signals SOEF by using the source output enable signal SOE transferred from the controller 400.

In this case, the random bit generator 351 may randomly generate two random bits, and thus, the bit mixer 352 may randomly generate the final source output enable signal SOEF also.

Therefore, timings at which data voltages are output to the data line DL may be divided into four timings.

However, as described above, the source output enable signal SOE may consist of at least four bits, and the random bit generator 351 may generate at least two random bits.

Therefore, when the number of random bits generated by the random bit generator 351 increases, timings at which data voltages are output to the data line DL may be variously divided also.

For example, when the number of random bits is three, the number of combinations capable of being generated by three random bits may be eight (for example, [000], [001], [010], [011], [100], [110], and [111]). Accordingly, when the number of random bits is three, timings at which data voltages are output may be divided into eight timings.

To provide an additional description, the switch 342 configuring the output buffer 340 may be turned on based on the final source output enable signal SOEF and may output a data voltage to a data line.

In this case, a timing at which the switch 342 is turned on may be determined by values of bits of the final source output enable signal SOEF.

Therefore, when the number of cases of the final source output enable signal SOEF is four, timings at which data voltages are output to the data line DL may be divided into four timings.

In this case, timings at which data voltages are output to a data line may vary with respect to falling timings of gate pulses output to gate lines.

Hereinafter, a detailed example thereof will be described with reference to FIGS. 6 to 8.

Figure 6:
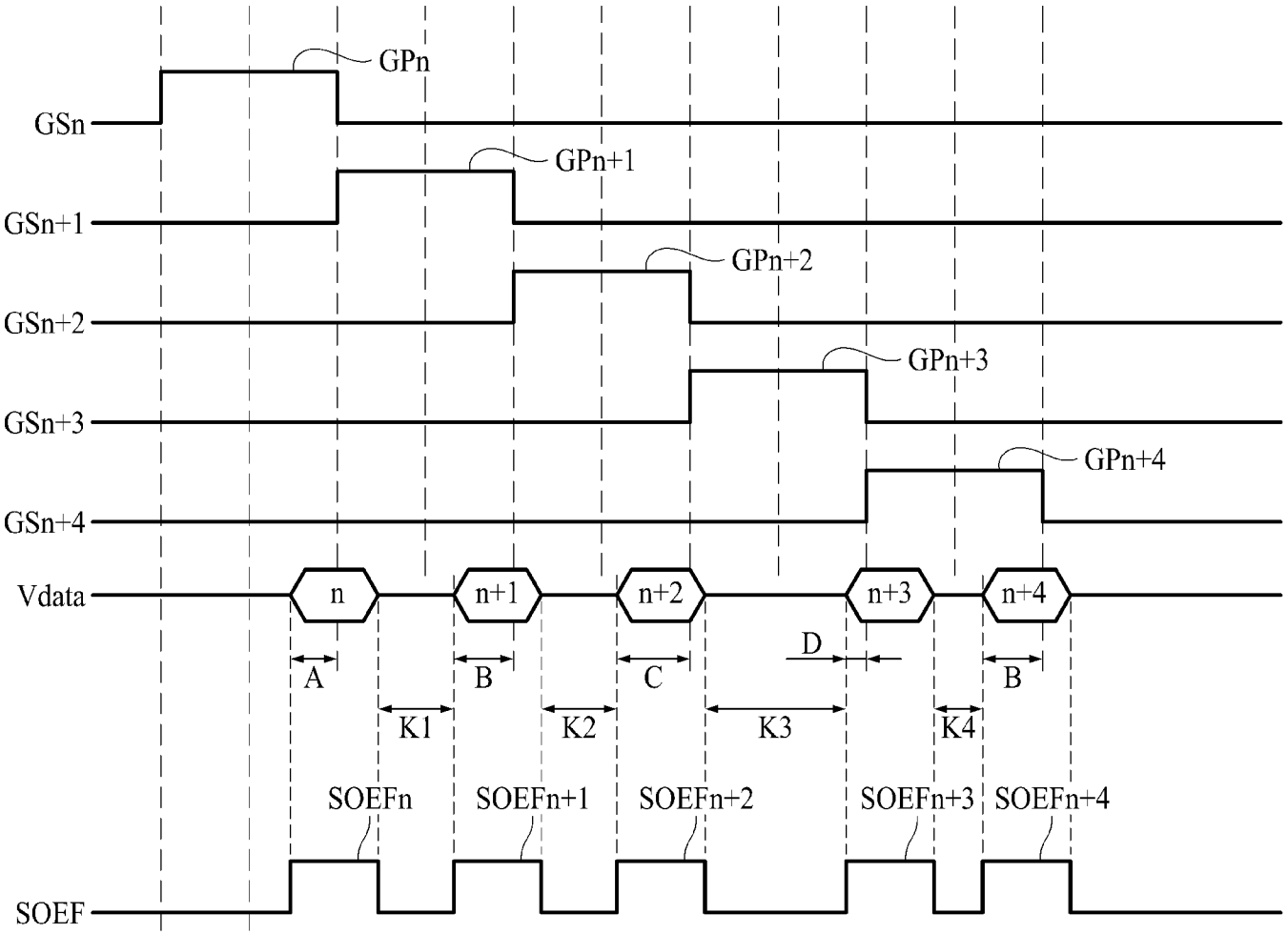
FIG. 6 is an exemplary diagram showing waveforms of gate signals and data voltages applied to a display apparatus according to the present disclosure.

FIG. 6 is an exemplary diagram showing waveforms of gate signals and data voltages applied to a display apparatus according to the present disclosure.

Hereinafter, a display apparatus where the source output enable signal SOE has eight bits and the random bit generator 351 generates two random bits will be described as an example of the present disclosure.

That is, as described above, when the source output enable signal SOE which is generated by the controller 400 and is supplied to the data driver 300 consists of eight bits and two random bits are generated by the random bit generator 351, the number of final source output enable signals SOEF capable of being generated by using one source output enable signal SOE may be four.

In this case, as illustrated in FIG. 6, an interval between the final source output enable signal SOEF and a falling timing of each of gate pulses output to gate lines may be controlled based on two random bits.

For example, as illustrated in FIGS. 1 and 6, five gate pulses GPn to GPn+4 output to five continuous gate lines GLn to GLn+4 may have the same pulse width and may have the same interval. That is, a timing at which the gate pulses GPn to GPn+4 rise and a timing at which the gate pulses GPn to GPn+4 fall may be repeated at the same interval.

In this case, a data voltage Vdata which is supplied through a data line at a timing at which a gate pulse GP falls may be finally charged into the pixel 110, and light corresponding to the charged voltage may be emitted from the pixel 110.

Therefore, when a data voltage Vdata overlaps at a timing at which the gate pulse GP falls, the overlapped data voltage Vdata may be supplied to the pixel.

In this case, as illustrated in FIG. 6, an interval between the final source output enable signal SOEF and a falling timing of each of the gate pulses GPn to GPn+4 may be controlled based on two random bits, and thus, timings at which data voltages are output to a data line may vary with respect to falling timings of gate pulses.

Particularly, according to the aspect, four final source output enable signals SOEF may be output based on two random bits, and thus, timings at which data voltages are output may be divided into four timings.

For example, $n^{th}$ data voltages n which are output to data lines at a timing at which an $n^{th}$ gate pulse GPn is output to an $n^{th}$ gate line GLn may be output based on an $n^{th}$ final source output enable signal SOEFn. The final source output enable signal SOEF including the $n^{th}$ final source output enable signal SOEFn may have a digital value, but for convenience of description, a waveform of the final source output enable signal SOEF is shown in FIG. 6. In this case, the $n^{th}$ final source output enable signal SOEFn may include random bits [00].

That is, the $n^{th}$ data voltages n may be output to pixels connected to the $n^{th}$ gate line GLn on the basis of the $n^{th}$ final source output enable signal SOEFn including the random bits [00].

In this case, as illustrated in FIG. 6, an interval between a timing at which the $n^{th}$ gate pulse GPn falls and a timing at which the $n^{th}$ data voltages n are output to the data lines may be an interval A.

Moreover, $n+1^{th}$ data voltages n+1 which are output to data lines at a timing at which an $n+1^{th}$ gate pulse GPn+1 is output to an $n+1^{th}$ gate line GLn+1 may be output based on an $n+1^{th}$ final source output enable signal SOEFn+1. In this case, the $n+1^{th}$ final source output enable signal SOEFn+1 may include random bits [01].

That is, the $n+1^{th}$ data voltages n+1 may be output to pixels connected to the $n+1^{th}$ gate line GLn+1 on the basis of the $n+1^{th}$ final source output enable signal SOEFn+1 including the random bits [01].

In this case, as illustrated in FIG. 6, an interval between a timing at which the $n+1^{th}$ gate pulse GPn+1 falls and a timing at which the $n+1^{th}$ data voltages n+1 are output to the data lines may be an interval B.

Moreover, $n+2^{th}$ data voltages n+2 which are output to data lines at a timing at which an $n+2^{th}$ gate pulse GPn+2 is output to an $n+2^{th}$ gate line GLn+2 may be output based on an $n+2^{th}$ final source output enable signal SOEFn+2. In this case, the $n+2^{th}$ final source output enable signal SOEFn+2 may include random bits [10].

That is, the $n+2^{th}$ data voltages n+2 may be output to pixels connected to the $n+2^{th}$ gate line GLn+2 on the basis of the $n+2^{th}$ final source output enable signal SOEFn+2 including the random bits [10].

In this case, as illustrated in FIG. 6, an interval between a timing at which the $n+2^{th}$ gate pulse GPn+2 falls and a timing at which the $n+2^{th}$ data voltages n+2 are output to the data lines may be an interval C.

Moreover, $n+3^{th}$ data voltages n+3 which are output to data lines at a timing at which an $n+3^{th}$ gate pulse GPn+3 is output to an $n+3^{th}$ gate line GLn+3 may be output based on an $n+3^{th}$ final source output enable signal SOEFn+3. In this case, the $n+3^{th}$ final source output enable signal SOEFn+3 may include random bits [11].

That is, the $n+3^{th}$ data voltages n+3 may be output to pixels connected to the $n+3^{th}$ gate line GLn+3 on the basis of the $n+3^{th}$ final source output enable signal SOEFn+3 including the random bits [11].

In this case, as illustrated in FIG. 6, an interval between a timing at which the $n+3^{th}$ gate pulse GPn+3 falls and a timing at which the $n+3^{th}$ data voltages n+3 are output to the data lines may be an interval D.

In this case, the interval A, the interval B, the interval C, and the interval D may differ. Accordingly, data voltages output through one data line DL may be output at different timings for each gate line.

However, at least two of the interval A, the interval B, the interval C, and the interval D may be the same, and the interval A, the interval B, the interval C, and the interval D may not be repeated.

That is, in the present disclosure, two random bits may be randomly selected by the random bit generator 351. Accordingly, random bits [00], random bits [01], random bits [10], and random bits [11] may not sequentially be selected, and an order in which the random bits [00], the random bits [01], the random bits [10], and the random bits [11] are selected may not be fixed.

For example, in the above-described aspect, the final source output enable signals SOEFn, SOEFn+1, SOEFn+2, and SOEFn+3 may be generated by sequentially selecting the random bits [00], the random bits [01], the random bits [10], and the random bits [11], or the final source output enable signals SOEFn, SOEFn+1, SOEFn+2, and SOEFn+3 may be generated in the order of the random bits [00], the random bits [01], the random bits [10], and the random bits [11].

Moreover, the final source output enable signals SOEFn and SOEFn+1 including the random bits [00] and the random bits [11] may be generated, and then, the final source output enable signals SOEFn+2 and SOEFn+3 including the random bits [01] and the random bits [10] may be generated.

To provide an additional description, $n+4^{th}$ data voltages n+4 which are output to data lines at a timing at which an $n+4^{th}$ gate pulse GPn+4 is output to an $n+4^{th}$ gate line GLn+4 may be output based on an $n+4^{th}$ final source output enable signal SOEFn +4. In this case, the $n+4^{th}$ final source output enable signal SOEFn+4 may include one of the random bits [00], the random bits [01], the random bits [10], and the random bits [11].

For example, in FIG. 6, an example where the $n+4^{th}$ final source output enable signal SOEFn+4 is output based on the random bits [01] is illustrated. Accordingly, as illustrated in FIG. 6, an interval between a timing at which the $n+4^{th}$ final source output enable signal SOEFn+4 falls and a timing at which the $n+4^{th}$ data voltages n+4 are output to the data lines may be an interval B.

Therefore, a timing at which the $n+4^{th}$ data voltages n+4 are output to the data lines on the basis of the $n+4^{th}$ final source output enable signal SOEFn+4 may be the same as a timing at which the $n+4^{th}$ data voltages n+1 are output to the data lines on the basis of the $n+1^{th}$ final source output enable signal SOEFn+1.

That is, four random bit pairs described above may not be selected once at every four times, and the order thereof may be variously changed also.

Therefore, according to the present disclosure, a timing at which data voltages are output to gate lines may not be based on a certain rule. Accordingly, according to the present disclosure, EMI which occurs because data voltages are output at a constant timing may be prevented or minimized.

Figure 7:
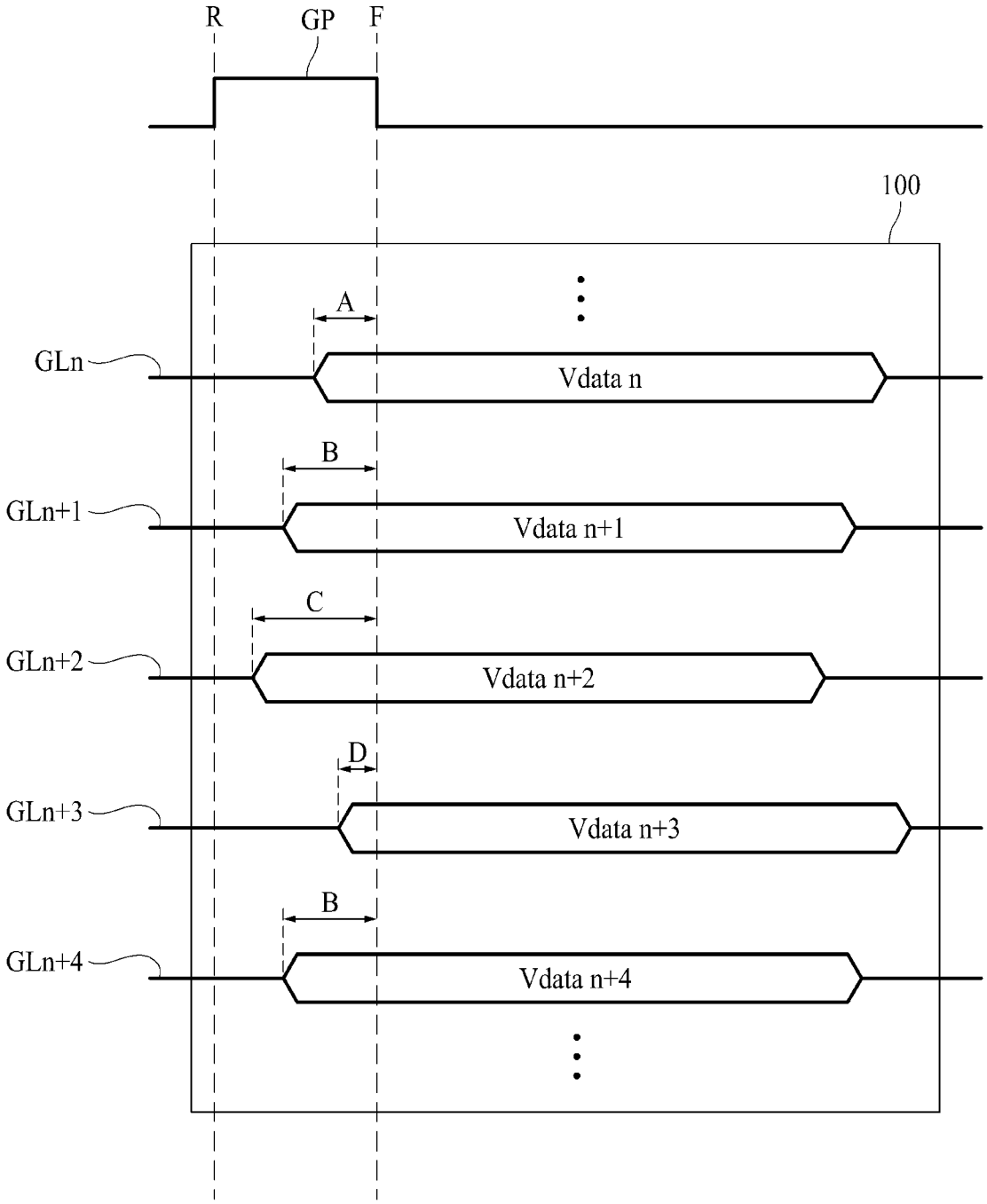
FIGS. 7 and 8 are exemplary diagrams for describing output timings of data voltages output by a display apparatus according to the present disclosure.
Figure 8:
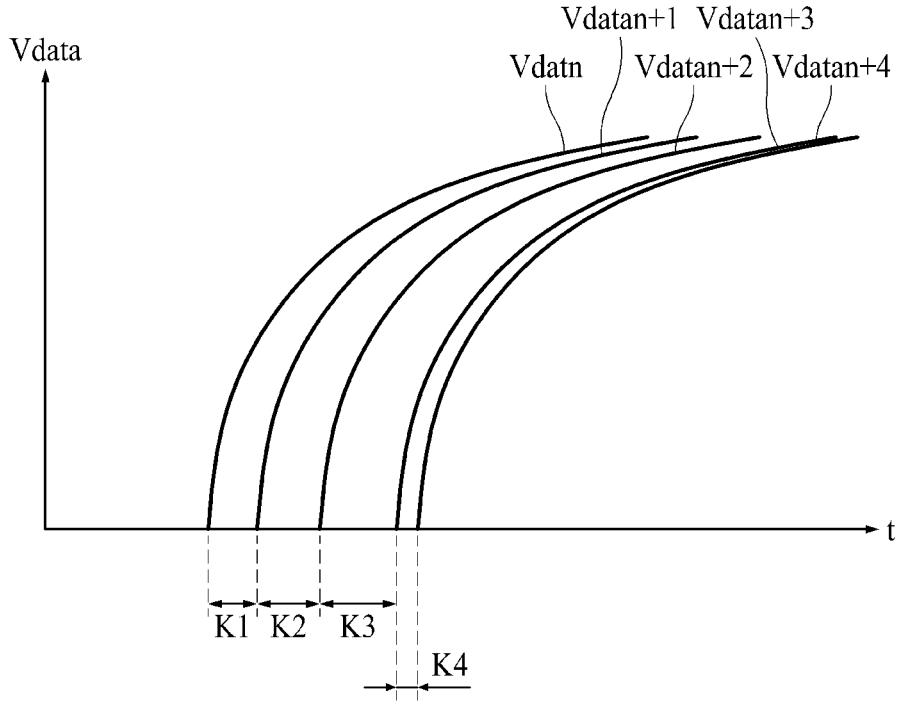

FIGS. 7 and 8 are exemplary diagrams for describing output timings of data voltages output by a display apparatus according to the present disclosure. Particularly, FIG. 7 is an exemplary diagram showing visually an example where timings, at which data voltages are output to gate lines, differ.

That is, as described above, a timing at which $n^{th}$ data voltages Vdatan are output to pixels connected to an $n^{th}$ gate line GLn may differ from a timing at which $n+1^{th}$ data voltages Vdatan+1 are output to pixels connected to an $n+1^{th}$ gate line GLn+1.

Therefore, as illustrated in FIG. 7, a timing at which a data voltage is output may vary for each gate line, and particularly, timings at which data voltages are output to a data line may vary with respect to falling timings of gate pulses GP output to gate lines.

To provide an additional description, as illustrated in FIG. 7, a rising timing R and a falling timing F of each of gate pulses GP output to $n^{th}$ to $n+4^{th}$ gate lines GLn to GLn+4 may be constant.

However, with respect to the falling timing F of the gate pulse GP, timings at which $n^{th}$ to $n+4^{th}$ data voltages Vdatan to Vdatan+4 are output may differ. However, the timings at which the $n^{th}$ to $n+4^{th}$ data voltages Vdatan to Vdatan+4 are output may include the same timings. That is, in the aspects of FIGS. 6 and 7, a timing B at which the $n+4^{th}$ data voltages Vdatan+4 are output to data lines by an $n+4^{th}$ final source output enable signal SOEFn+4 may be the same as a timing at which the $n+1^{th}$ data voltages Vdatan+1 are output to data lines by an $n+1^{th}$ final source output enable signal SOEFn+1.

Therefore, as illustrated in FIG. 8, intervals K1 to K4 between timings at which the data voltages Vdatan to Vdatan+4 are output to data lines may be randomly changed also.

As described above, according to the present disclosure, a timing at which data voltages are output to gate lines may not be based on a certain rule. Accordingly, according to the present disclosure, EMI which occurs because data voltages are output at a constant timing may be prevented or minimized.

In the present disclosure, a timing at which a data voltage is output to a data line may be randomly changed for each gate line. Accordingly, according to the present disclosure, EMI which occurs because data voltages are output at a constant timing may be prevented or minimized.

The above-described feature, structure, and effect of the present disclosure are included in at least one aspect of the present disclosure, but are not limited to only one aspect. Furthermore, the feature, structure, and effect described in at least one aspect of the present disclosure may be implemented through combination or modification of other aspects by those skilled in the art. Therefore, content associated with the combination and modification should be construed as being within the scope of the present disclosure.

It will be apparent to those skilled in the art that various modifications and variations can be made in the present disclosure without departing from the spirit or scope of the disclosures. Thus, it is intended that the present disclosure covers the modifications and variations of this disclosure provided they come within the scope of the appended claims and their equivalents.

What is claimed is:

1. A display apparatus comprising:

a display panel including a gate line and a data line;

a controller generating a source output enable signal determining an output timing of a data voltage output to the data line; and a data driver including a signal changer, generating a final source output enable signal by using the source output enable signal, and randomly changing the output timing of the data voltage for each gate line by using the final source output enable signal.

2. The display apparatus of claim 1, wherein the source output enable signal comprises at least four bits.

3. The display apparatus of claim 2, wherein the data driver changes at least two of the at least four bits to generate the final source output enable signal and randomly changes the output timing of the data voltage for each gate line by using the final source output enable signal.

4. The display apparatus of claim 1, wherein the data driver further comprises:

a latch unit latching image data received from the controller;

a digital-to-analog converter converting the image data, transferred from the latch unit, into a data voltage and outputting the data voltage; and an output buffer outputting the data voltage, transferred from the digital-to-analog converter, to the data line on the basis of the final source output enable signal.

5. The display apparatus of claim 4, wherein the output buffer comprises:

a buffer storing the data voltage transferred from the digital-to-analog converter; and a switch transferring the data voltage, stored in the buffer, to the data line on the basis of the final source output enable signal.

6. The display apparatus of claim 4, wherein the final source output enable signal comprises at least four bits.

7. The display apparatus of claim 6, wherein the signal changer comprises:

a random bit generator generating at least two random bits; and a bit mixer replacing at least two of the at least four bits with the at least two random bits to generate the final source output enable signal.

8. The display apparatus of claim 7, wherein timings, at which data voltages are output to the data line, are divided into at least four timings.

9. The display apparatus of claim 8, wherein the timings, at which the data voltages are output to the data line, differ with respect to falling timings of gate pulses output to gate lines included in the display panel.

10. The display apparatus of claim 7, wherein a timing, at which an $n^{th}$ data voltage is output through the data line to a pixel connected to an $n^{th}$ gate line of gate lines included in the display panel, differs from a timing at which an $n+1^{th}$ data voltage is output through the data line to a pixel connected to an $n+1^{th}$ gate line.

11. The display apparatus of claim 1, wherein the output timing differs from falling timings of gate pulses output to the gate line included in the display panel.

* * * * *